US007451888B2

(12) United States Patent
Tanaka

(10) Patent No.: US 7,451,888 B2
(45) Date of Patent: Nov. 18, 2008

(54) LID OPENING AND CLOSING APPARATUS WITH MECHANISM FOR ASSISTING OPENING AND CLOSING OF LID

(75) Inventor: Tsutomu Tanaka, Tochigi (JP)

(73) Assignee: Nifco Inc., Yokohama (JP)

( * ) Notice: Subject to any disclaimer, the term of this patent is extended or adjusted under 35 U.S.C. 154(b) by 763 days.

(21) Appl. No.: 11/012,232

(22) Filed: Dec. 16, 2004

(65) Prior Publication Data

US 2005/0133507 A1 Jun. 23, 2005

(30) Foreign Application Priority Data

Dec. 19, 2003 (JP) ..... 2003-422653

(51) Int. Cl.
*B65D 43/26* (2006.01)

(52) U.S. Cl. ..... 220/263; 220/264; 220/827; 220/830

(58) Field of Classification Search ..... 220/263, 220/827, 830, 264; 224/282; 296/37.8
See application file for complete search history.

(56) References Cited

U.S. PATENT DOCUMENTS

| | | | | |
|---|---|---|---|---|
| 5,520,313 | A * | 5/1996 | Toshihide | 224/539 |
| 5,603,540 | A * | 2/1997 | Shibao | 292/341.15 |
| 5,718,405 | A * | 2/1998 | Adachi | 248/311.2 |
| 5,893,478 | A * | 4/1999 | Maruoka | 220/827 |
| 5,971,463 | A * | 10/1999 | Nowak et al. | 296/37.8 |
| 7,063,225 | B2 * | 6/2006 | Fukuo | 220/264 |

FOREIGN PATENT DOCUMENTS

JP 2003-2059 1/2003

* cited by examiner

*Primary Examiner*—Robin Hylton
(74) *Attorney, Agent, or Firm*—Manabu Kanesaka

(57) ABSTRACT

A lid opening and closing apparatus includes a base having an open portion; a lid having a rotational shaft and supported on the base to be rotatable around the rotating shaft for opening and closing the open portion; and a connecting device with one spring disposed between the base and the lid. The one spring is stretched for urging the lid in an opening direction when the lid is pushed to a pushed-in position beyond a closed position. The one spring is stretched for urging the lid in a closing direction when the lid is closed by a predetermined angle.

9 Claims, 9 Drawing Sheets

10

24
91
20
110
32
26
122(120)
35
93
36
102
100
27
70
90
51
80
37

LID OPENING AND CLOSING APPARATUS WITH MECHANISM FOR ASSISTING OPENING AND CLOSING OF LID

BACKGROUND OF THE INVENTION AND RELATED ART STATEMENT

The invention relates to a lid opening and closing apparatus of a compartment or the like, and in particular, a lid opening and closing apparatus in which a lid can be opened and closed in an opening direction and a closing direction with an urging force of a single spring.

Conventionally, as such a lid opening and closing device, there is known a device in which a spring urges a lid from a closed position to an open position (see Patent Document 1).

Patent Document 1: Japanese Patent Publication (Kokai) No. 2003-2059 (Paragraph [0008])

However, in such a conventional lid opening and closing apparatus, it is necessary to close the lid with a hand, thereby causing a nuisance. It is also necessary to close the lid with a hand against an urging force of the spring, thereby causing a problem. In view of the problems described above, the present invention has been made, and has the following objects.

According to a first aspect of the invention, a lid can be opened and closed in both directions, i.e., an opening direction and a closing direction, with an urging force of a single spring.

According to the first aspect of the invention, it is sufficient to provide the single spring, thereby reducing the number of parts. Also, the spring urges the lid in the closing direction, thereby securely closing the lid. Furthermore, the spring urges the lid in the closing direction, thereby preventing the lid from unexpectedly opening from the closed position. Therefore, according to the first aspect of the invention, it is possible to eliminate a locking mechanism for locking the lid at the closed position.

A second aspect of the present invention-has the following object in addition to the object of the first aspect of the invention. That is, according to the second aspect of the invention, the lid can be opened and closed in both directions, i.e., the opening direction and the closing direction, with a comparatively simple structure.

A third aspect of the invention has the following object in addition to the object of one of the first and second aspects of the invention. That is, according to the third aspect of the invention, the lid can be closed using the urging force of the spring when the lid is closed by 45 degrees from the closed position.

A fourth aspect of the invention has the following object in addition to the object of one of the first to third aspects of the invention. That is, according to the fourth aspect of the invention, the lid can be opened and closed in both directions i.e., the opening direction and the closing direction, with a comparatively simple structure of an engagement of a guide groove and a pin.

A fifth aspect of the invention has the following object in addition to the object of one of the first to fourth aspects of the invention. That is, according to the fifth aspect of the invention, a locking part of the pin is provided in the guide groove for securely opening the lid.

A sixth aspect of the invention has the following object in addition to the object of one of the first to fifth aspects of the invention. That is, according to the fifth aspect of the invention, the pin engages a stopper while opening the lid so that the pin can be moved to a suitable position in the guide groove.

A seventh aspect of the invention has the following object in addition to the object of one of the first to sixth aspects of the invention. That is, according the seventh aspect of the invention, it is arranged such that a push arm can return assuredly.

An eighth aspect of the invention has the following object in addition to the object of one of the first to seventh aspects of the invention. That is, according to the eighth aspect of the invention, a damper device is provided for opening the lid slowly and quietly with a damping force thereof. In addition, the damper device is provided for opening the lid slowly and quietly with the damping force thereof.

Further objects and advantages of the invention will be apparent from the following description of the invention.

SUMMARY OF THE INVENTION

Each aspect of the invention is made to achieve each object mentioned above.

The first aspect of the invention has the following features. That is, the lid opening and closing apparatus has the following structure.

(1) Base

The base has an open part.

(2) Lid

The lid is supported to be capable of rotating around a rotating shaft on the base, and opens and closes the open part.

(3) Spring

The spring is singular. Also, the spring is placed between the base and the lid. Furthermore, the spring is stretched when the lid is pushed in to a pushed-in position beyond a closed position, and urges the lid in the opening direction with the spring returning force.

Also, the spring is stretched again by the lid when the lid is closed by a predetermined angle after the lid is opened by the spring returning force, and forces the lid in the closing direction with the spring returning force.

The second aspect of the invention has the following features in addition to the features of the first aspect of the invention mentioned above. That is, between the base and the lid, the following structure is provided.

(1) First Link Arm

The first link arm has one end part supported on the base with a support shaft to be capable of rotating.

(2) Second Link Arm

The second link arm has one end part supported on the first link arm to be capable of sliding. Also, the second link arm has the other end part provided with a pin. Furthermore, the second link arm is urged in a direction approaching the first link arm with the spring returning force of the spring placed between it and the first link arm.

(3) Push Arm

The push arm is supported on the base for moving the second link arm in a direction away from the first link arm to stretch the spring when the lid is pushed in to the pushed-in position.

(4) Guide Groove

The guide groove is provided on the lid for guiding the pin to be movable and moving the pin in a direction away from the first link arm to stretch the spring when the lid is closed by a predetermined angle from the open position.

The third aspect of the invention has the following features in addition to the features of the first or the second aspect of the invention recited mentioned above. That is, the predetermined angle is set to 45 degrees.

The fourth aspect of the invention has the following features in addition to the features of one of the first to third aspects of the invention. First, the guide groove allows the pin to move with an extension line of a line joining the rotating shaft of the lid and the support shaft of the first link arm as a boundary.

Second, the pin moves toward a backside away from a free end part of the lid with the extension line as the boundary to open the lid. The pin moves toward a front side approaching the free end part of the lid with the extension line as the boundary to close the lid.

The fifth aspect of the invention has the following features in addition to the features of one of the first to fourth aspects of the invention. First, the guide groove extends in a direction moving away from the support shaft of the first link arm at the closed position of the lid. For example, the guide groove has a starting end part near the support shaft and a locking part curved as extending away from the support shaft. Second, the push arm moves the second link arm in a direction away from the first link arm to move the pin from the front end part toward the locking part.

The sixth aspect of the invention has the following features in addition to the features of one of the first to fifth aspects of the invention. That is, a stopper is provided on the base for engaging the pin while opening the lid so that the pin moves from the locking part toward the starting end part.

The seventh aspect of the invention has the following features in addition to the features of one of the first to sixth aspects of the invention mentioned above.

First, the push arm has the following structure.

(1) Shaft Stopping Part

The shaft stopping part is positioned midway along a length thereof, and is supported on the base to be capable of rotating.

(2) Pressing Part

The pressing part (for example, pressing part of push rod), is positioned on one end part sandwiching the shaft stopping part, projects toward the lid, and is pushed down by the free end part of the lid.

(3) Push-Up Part

The push-up part is positioned on the other end part sandwiching the shaft stopping part, and pushes up the second link arm in a direction away from the first link arm. Second, between the push arm and the base, there is provided a return spring so that the pressing part (for example, the pressing part of push rod) is pushed down by the free end part of the lid to return the push arm rotated around the shaft stopping part.

The eight aspect of the invention has the following features in addition to the features of one of the first to seventh aspects of the invention. That is, between the base and the lid, there is provided a damper device for damping a rotational force acting on the lid.

The present invention is constituted as described above, and has effects as described below. According to the first aspect of the invention, the following effect is obtained. That is, according to the first aspect of the invention, the lid can be opened and closed in both directions, i.e., the opening direction and the closing direction, with the urging force of the single spring.

Accordingly, it is sufficient to provide the single spring, thereby reducing the number of parts. Also, the spring urges the lid in the closing direction, thereby securely closing the lid. Furthermore, the spring urges the lid in the closing direction, thereby preventing the lid from unexpectedly opening from the closed position. Therefore, according to the first aspect of the invention, it is possible to eliminate a locking mechanism for locking the lid at the closed position.

The second aspect of the present invention has the following effect in addition to the effect of the first aspect of the invention. That is, according to the second aspect of the invention, the lid can be opened and closed in both directions, i.e., the opening direction and the closing direction, with the comparatively simple structure.

The third aspect of the invention has the following effect in addition to the effect of the first or second aspect of the invention. That is, according to the third aspect of the invention, the lid can be closed using the urging force of the spring when the lid is closed by 45 degrees from the closed position.

The fourth aspect of the invention has the following-effect in addition to the effect of one of the first to third aspects of the invention. That is, according to the fourth aspect of the invention, the lid can be opened and closed in both directions i.e., the opening direction and the closing direction, with a comparatively simple structure of an engagement of a guide groove and a pin.

The fifth aspect of the invention has the following effect in addition to the effect of one of the first to fourth aspects of the invention. That is, according to the fifth aspect of the invention, the locking part of the pin is provided in the guide groove for securely opening the lid.

The sixth aspect of the invention has the following effect in addition to the effect of one of the first to fifth aspects of the invention. That is, according to the fifth aspect of the invention, the pin engages a stopper while opening the lid so that the pin can be moved to a suitable position in the guide groove.

The seventh aspect of the invention has the following effect in addition to the effect of one of the first to sixth aspects of the invention. That is, according the seventh aspect of the invention, it is arranged such that the push arm can return assuredly.

The eighth aspect of the invention has the following effect in addition to the effect of one of the first to seventh aspects of the invention. That is, according to the eighth aspect of the invention, the damper device is provided for opening the lid slowly and quietly with a damping force thereof. In addition, the damper device is provided for opening the lid slowly and quietly with the damping force thereof.

BRIEF DESCRIPTION OF THE DRAWINGS

FIG. 6 is a side view of the opening and closing apparatus corresponding to FIG. 2 showing a state in which the closed lid is pushed in;

DETAILED DESCRIPTION OF PREFERRED EMBODIMENTS

Figure 1:
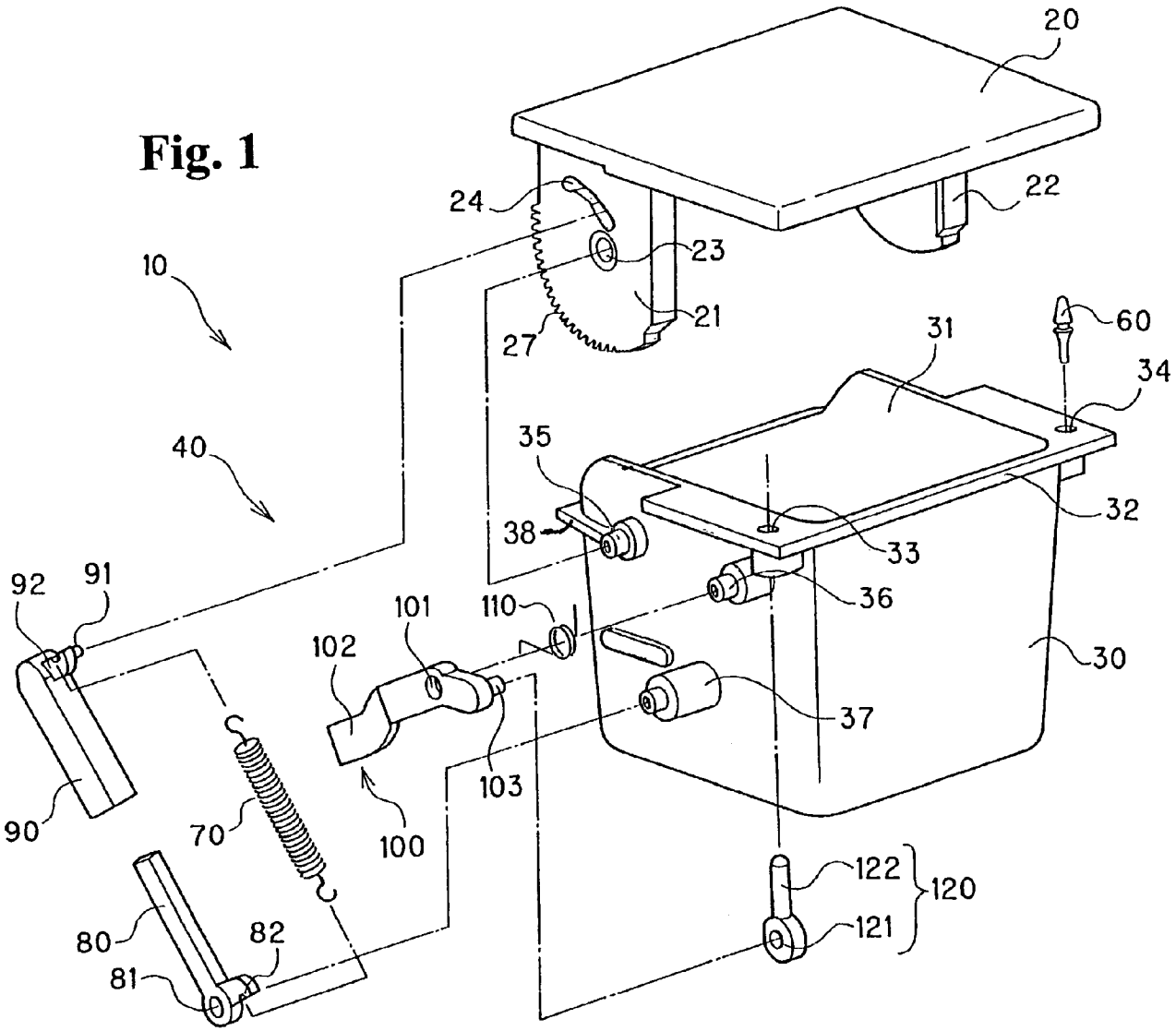
FIG. 1 is an exploded perspective view of a lid opening and closing apparatus.
Figure 2:
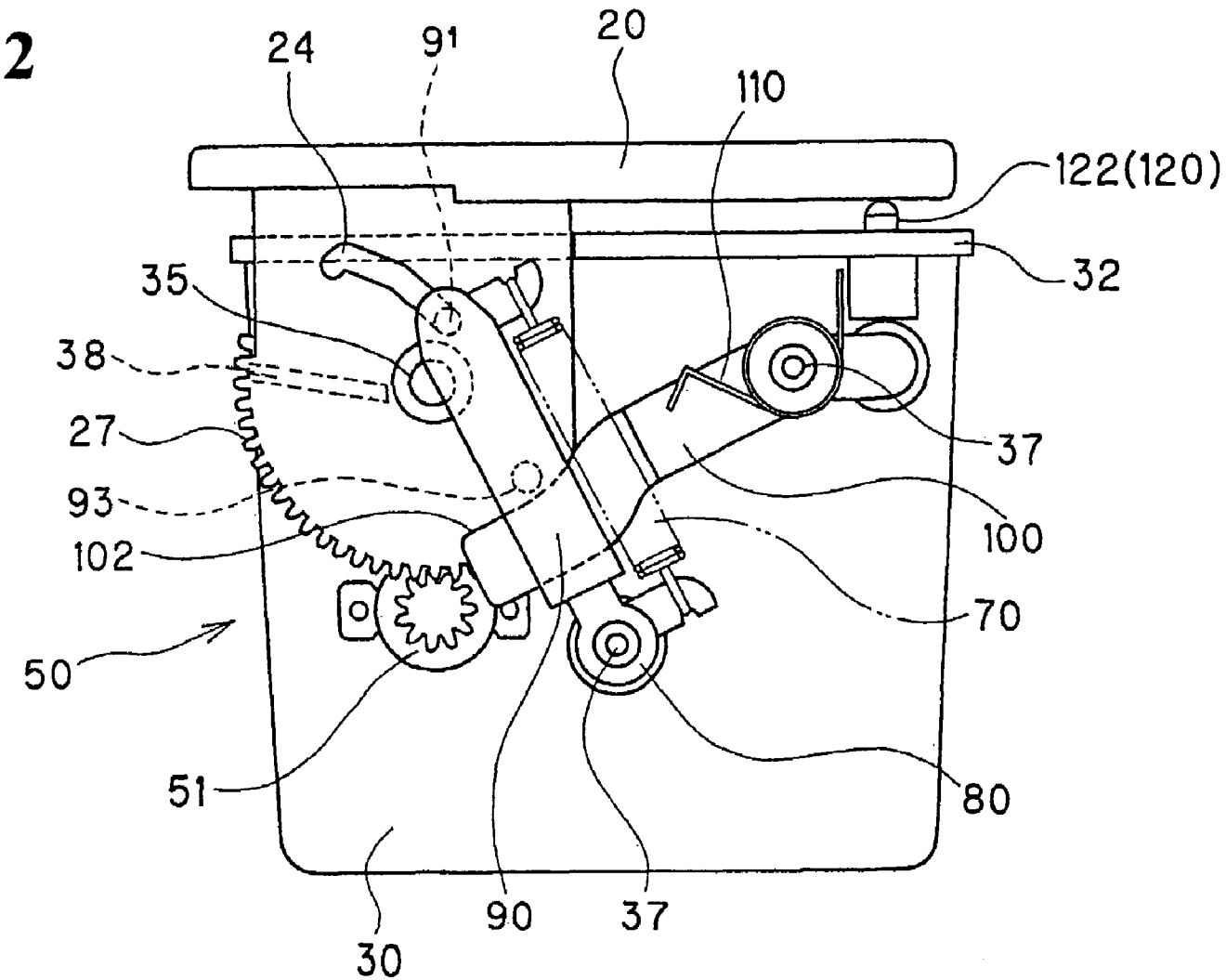
FIG. 2 is a side view of the lid opening and closing apparatus in a closed state of a lid.
Figure 3:
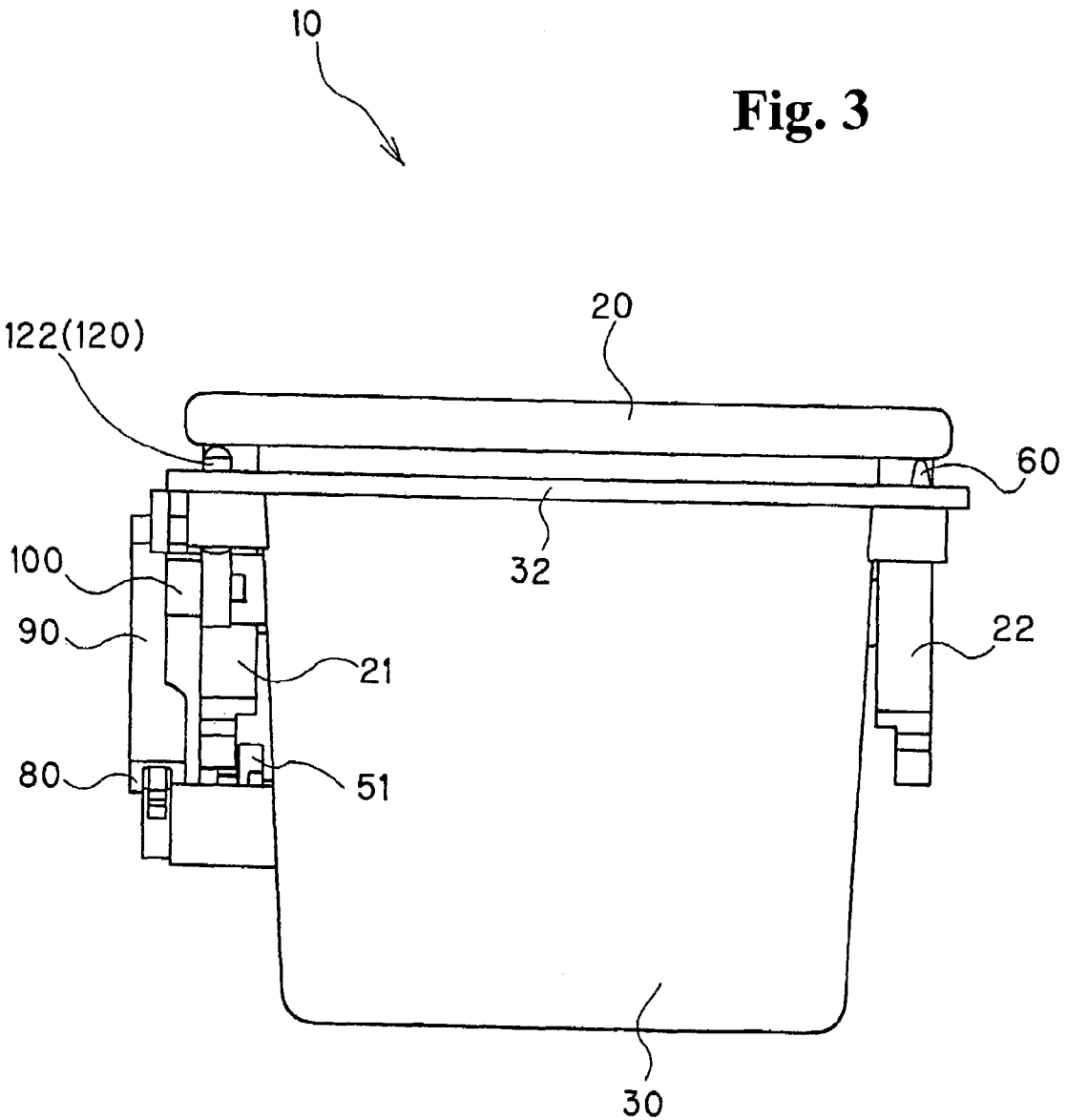
FIG. 3 is a front view of FIG. 2.
Figure 4:
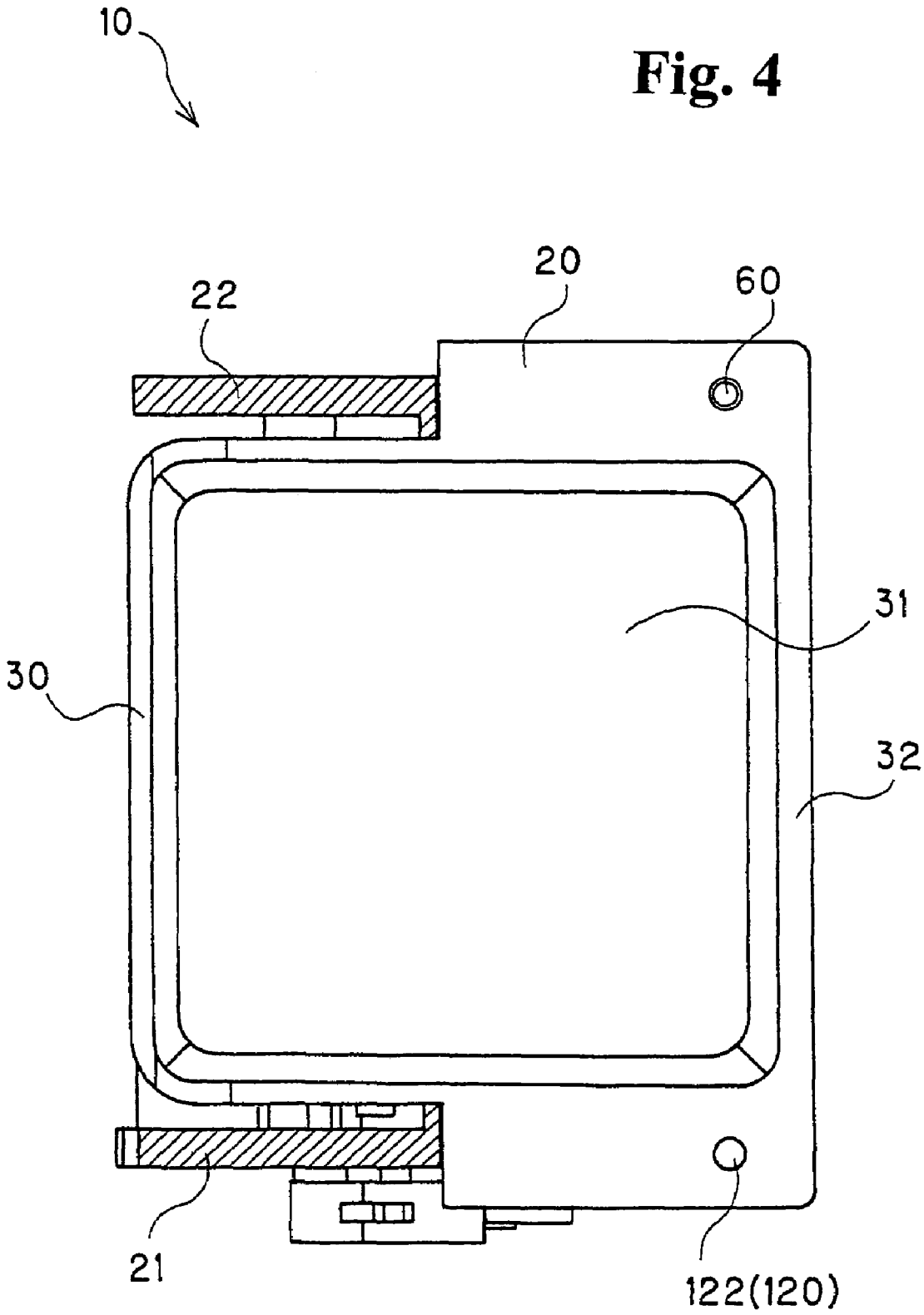
FIG. 4 is a partial sectional rear view of FIG. 2.
Figure 5:
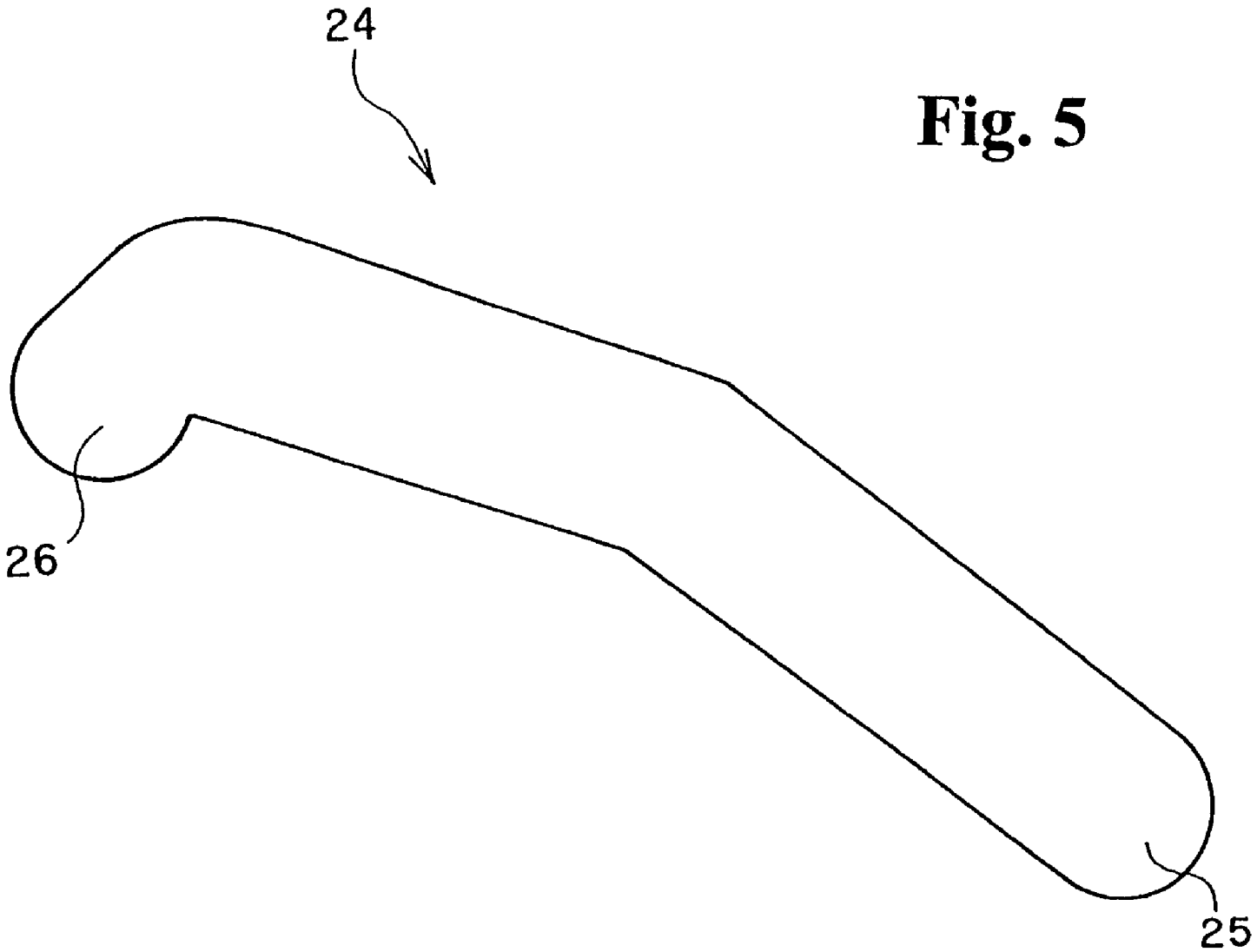
FIG. 5 is an enlarged view of a guide groove of the lid.
Figure 6:
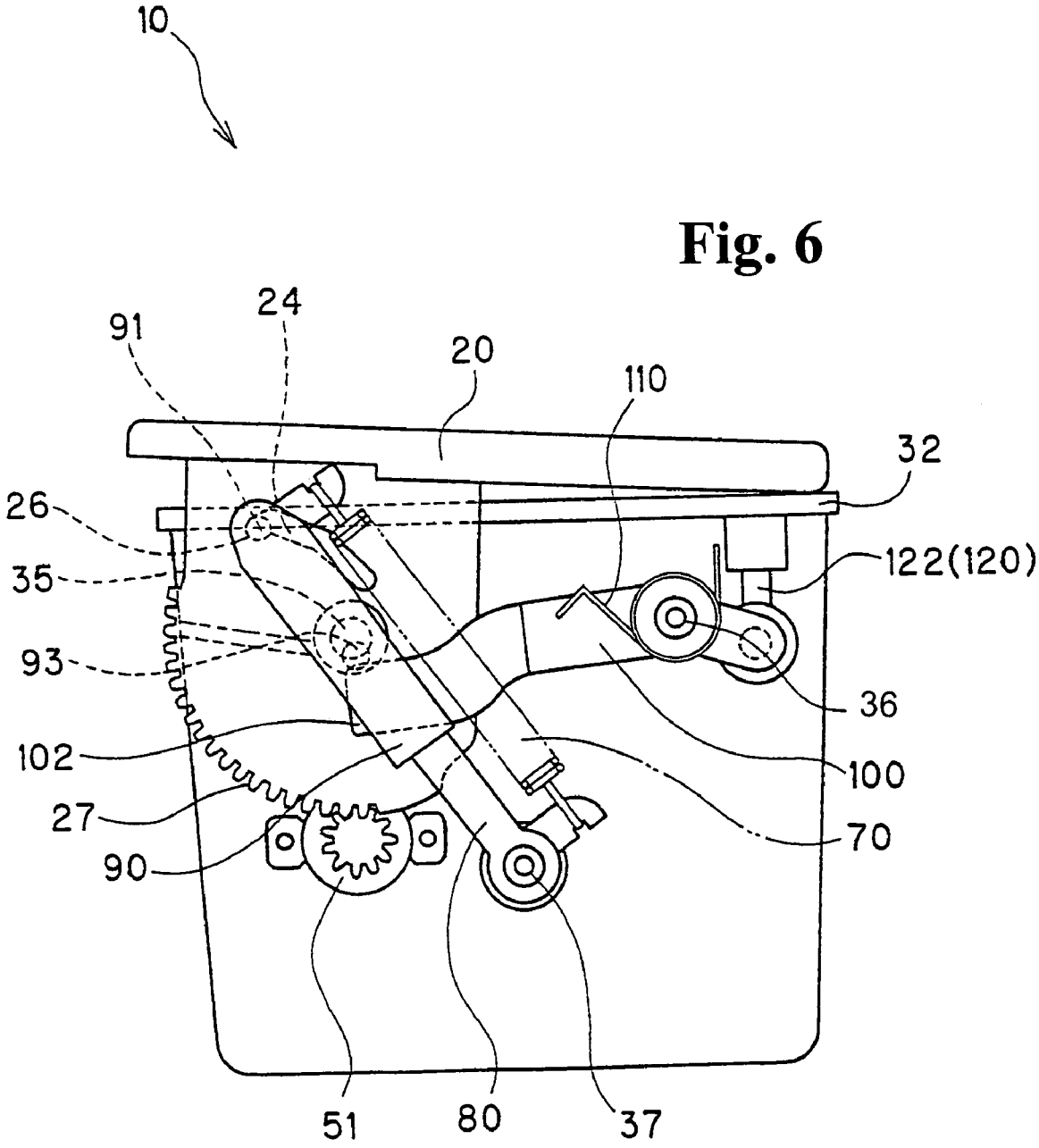
Figure 7:
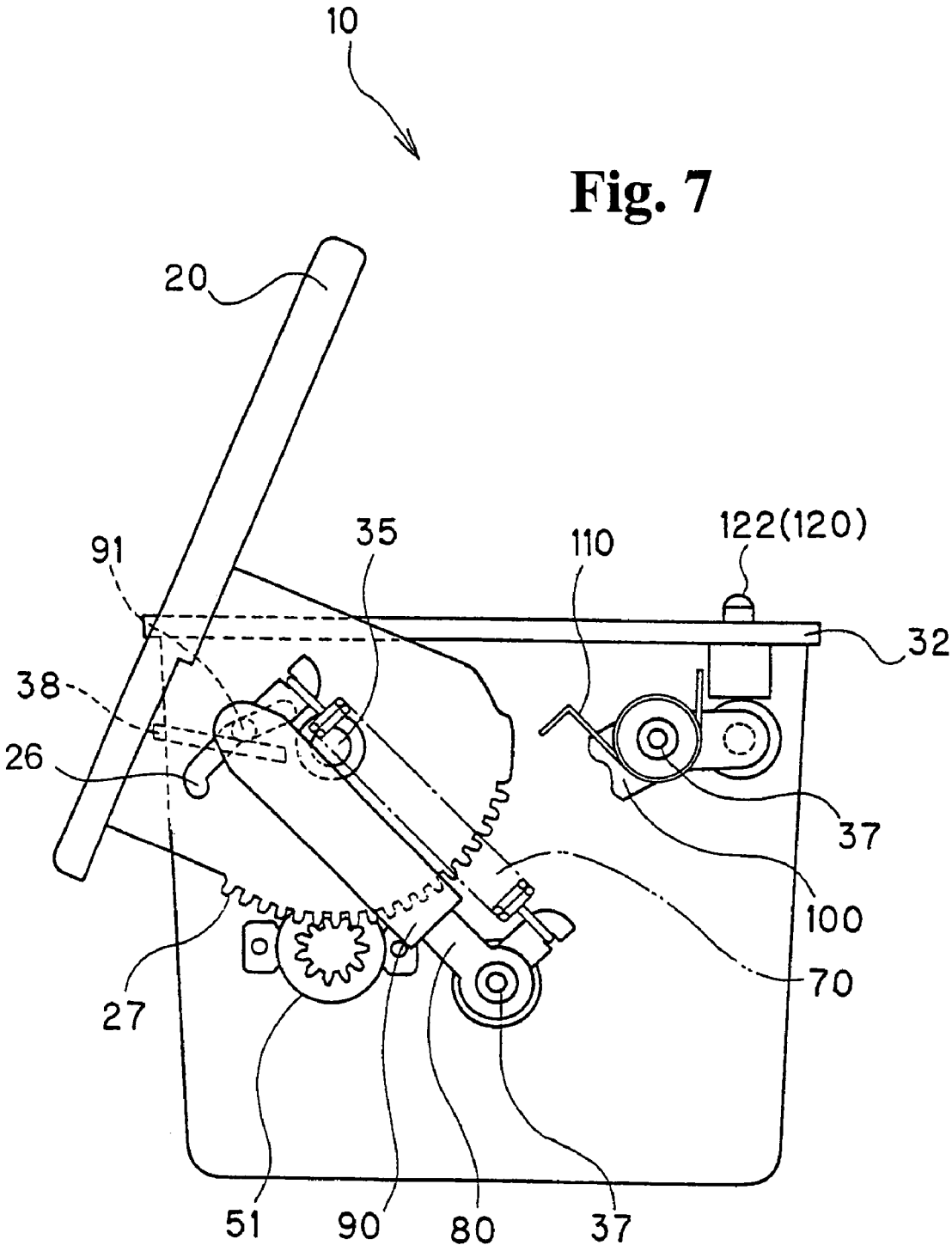
FIG. 7 is a side view of the opening and closing apparatus corresponding to FIG. 2 showing a state in which the lid is in a course of opening.
Figure 8:
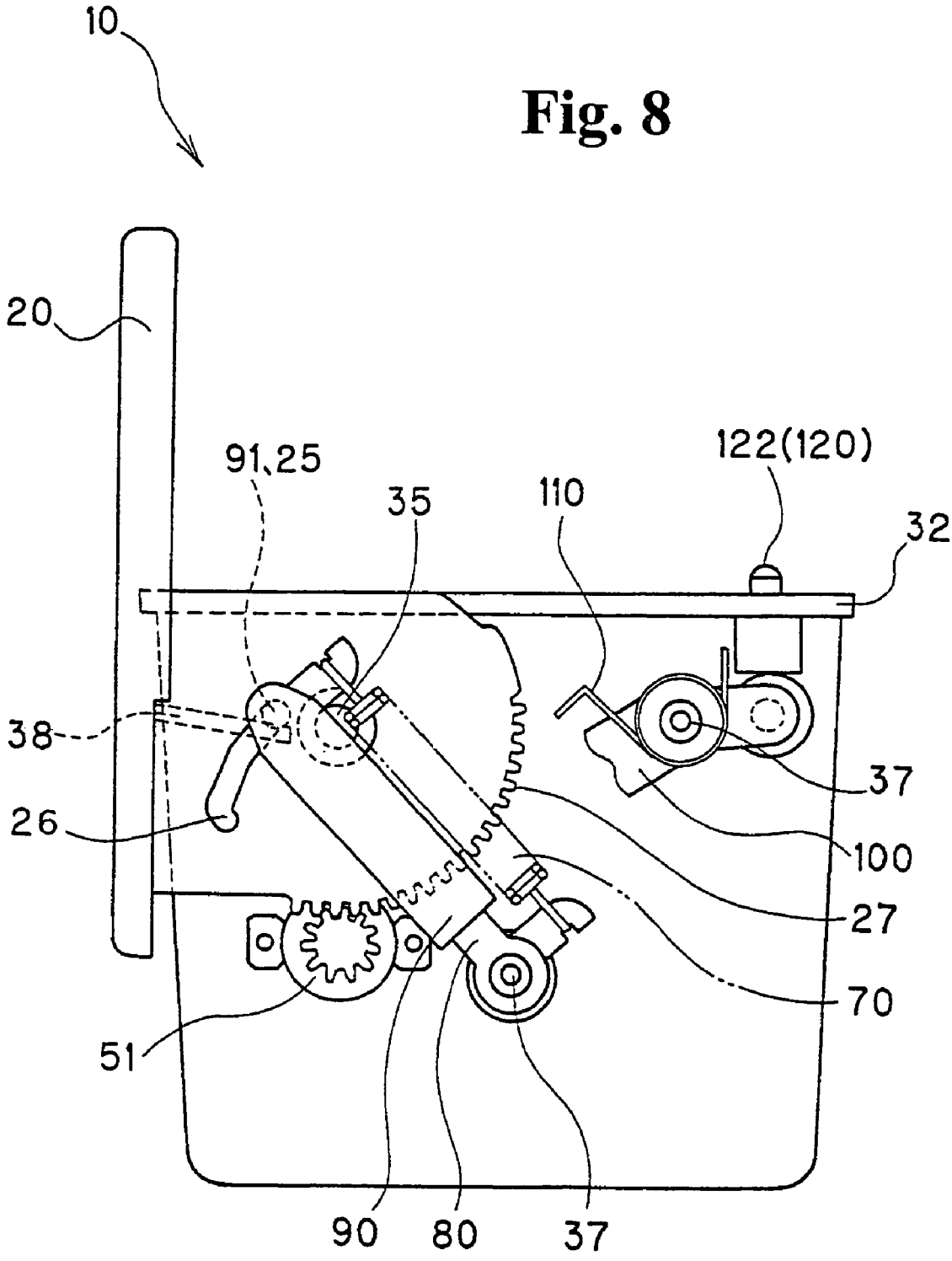
FIG. 8 is a side view of the opening and closing apparatus corresponding to FIG. 2 showing an open state of the lid.
Figure 9:
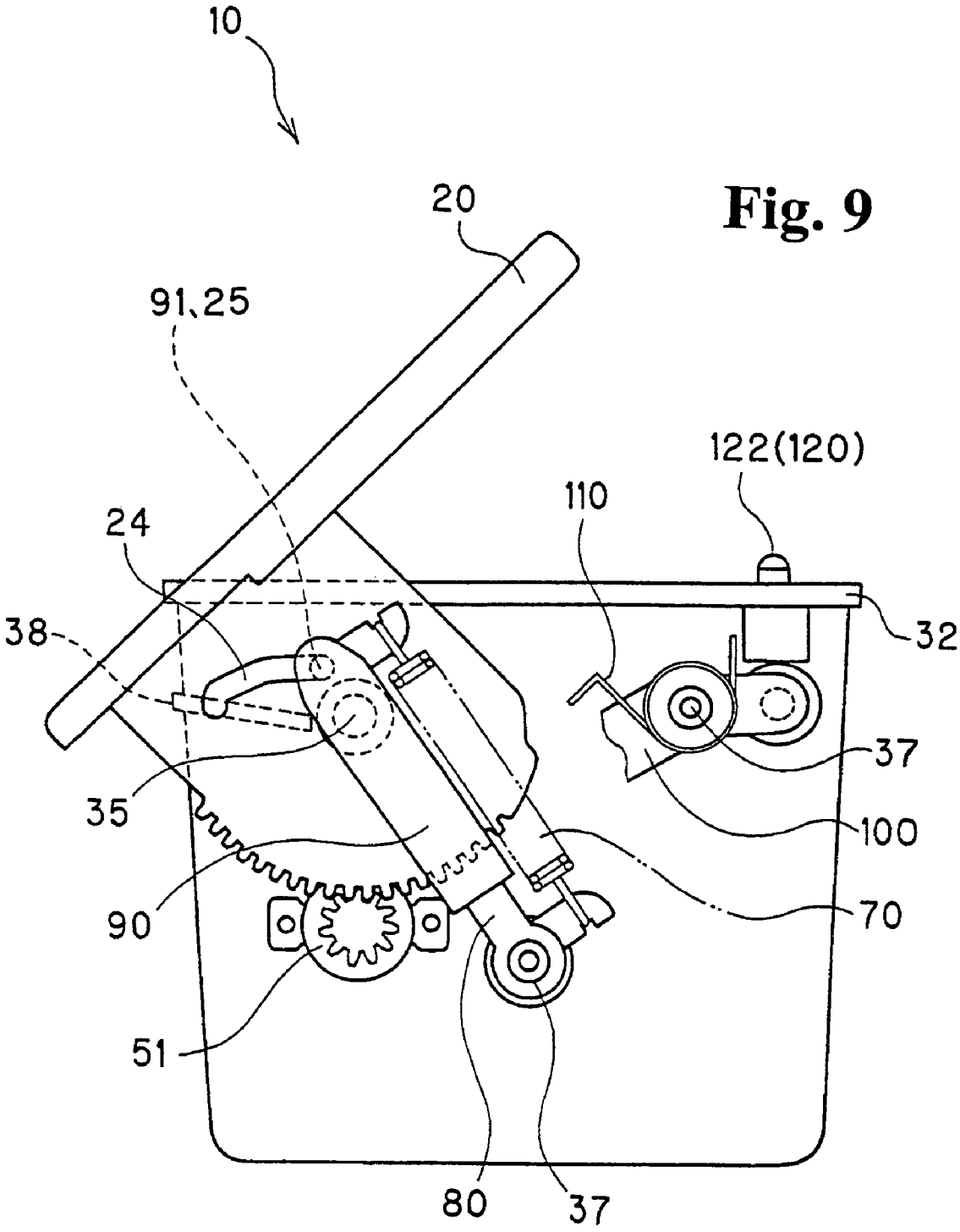
FIG. 9 is a side view of the opening and closing apparatus corresponding to FIG. 2 showing a state in which the lid is in the course of closing.

FIGS. 1 to 9 respectively show one example of an embodiment of the present invention. FIG. 1 is an exploded perspective view of a lid opening and closing apparatus. FIG. 2 is a side view of the lid opening and closing apparatus showing a closed state of a lid. FIG. 3 is a front view of FIG. 2. FIG. 4 is a partial sectional rear view of FIG. 2. FIG. 5 is an enlarged view of a guide groove of the lid. FIG. 6 is a side view of the opening and closing apparatus corresponding to FIG. 2 showing a state in which the closed lid is pushed in. FIG. 7 is a side view of the opening and closing apparatus corresponding to FIG. 2 showing a state in which the lid is in a course of opening. FIG. 8 is a side view of the opening and closing apparatus corresponding to FIG. 2 showing an open state of the lid. FIG. 9 is a side view of the opening and closing apparatus corresponding to FIG. 2 showing a state in which the lid is in the course of closing.

Opening and Closing Apparatus 10 of Lid 20

In the drawings, reference numeral 10 indicates an opening and closing apparatus of the lid 20.

The opening and closing apparatus 10, for example, is used as a compartment, and fixed in an embedded manner in a center console of an automobile (not shown). The opening and closing apparatus 10 is not limited to a compartment, and may be used for an ashtray, coin case, or the like. An installation place of the opening and closing apparatus 10 also is not limited to the center console of an automobile, and may be installed in an automobile instrument panel, inner wall of door, inner wall of body, back of seat, elbow rest or floor, or the like. Furthermore, the installation place of the opening and closing apparatus 10 is not limited to an automobile, and may be installed in an electric train, ship, office machinery or furniture, or the like.

The opening and closing apparatus 10, as shown in FIGS. 1 to 4, generally comprises the following parts.

(1) Base 30; (2) Lid 20; (3) Spring device 40; (4) Damper device 50; and (5) Cushion member 60.

The parts of the opening and closing apparatus 10 are not limited to (1) to (5).

Base 30

The base 30, as shown in FIG. 1, is formed in a hollow case having an open part 31 at an upper surface.

The base 30, as shown in FIG. 1, has the following parts. The parts of the base 30 are not limited to (1) to (5).

(1) Flange 32

The flange 32, as shown in FIG. 1, projects outwardly from a periphery of the open part 31. On left and right sides of the flange 32, as shown in FIG. 1, there are provided pass-through holes 33 to 34 passing through top to bottom. Of the left and right pass-through holes 33 to 34, as shown in FIG. 3, in the pass-through hole 33 on the left side, a pressing part 122 of a push rod 120 (described later) is installed to be capable of sliding in a vertical direction. Of the left and right pass-through holes 33 to 34, in the pass-through hole 34 on the right side, a cushion member 60 (described later) is installed.

(2) Rotating Shafts 35

A pair of rotating shafts 35 is provided on left and right sides, as shown in FIG. 1, and project outwardly in a cylindrical form from the left and right sides of the base 30, respectively. The left and right rotating shafts 35, as shown in FIG. 2, are positioned on a backside for supporting the lid 20 to be capable of opening and closing.

(3) Swivel Shaft 36

The swivel shaft 36, as shown in FIG. 1, projects outwardly in a cylindrical form from a left side surface of the base 30 on the left side. The swivel shaft 36, as shown in FIG. 2, is positioned on a front side relative to the rotating shaft 35 for supporting a push arm 100 (described later) so as to be capable of swiveling.

(4) Support Shaft 37

The support shaft 37, as shown in FIG. 1, projects outwardly in a cylindrical form from a left side surface of the base 30. The support shaft 37, as shown in FIG. 2, is positioned beneath the rotating shaft 35 and the swivel shaft 36 for supporting a first link arm 80 (described later) so as to be capable of rotation.

(5) Stopper 38

The stopper 38, as shown in FIG. 1, projects outwardly in an oblong form in plan view from the left side surface of the base 30. The stopper 38 (described later), as shown in FIG. 7, engages a pin 91 in a course of opening of the lid 20, and moves the pin 91 from a locking part 26 to a starting end part 25.

Lid 20

The lid 20, as shown in FIG. 2, is supported on the left and right rotating shafts 35 of the base 30 to be capable of rotating, and opens and closes the open part 31.

The directions of opening and closing of the lid 20 is not limited to the vertical direction, and may be a horizontal, downward, or diagonal direction. Concretely, the lid 20, as shown in FIG. 1, has the following parts.

(1) Hinge Parts 21-22

The hinge parts 21-22, as shown in FIG. 1, extend as a pair from the left and right sides of the lid 20.

(2) Rotation Holes 23

The rotation holes 23, as shown in FIG. 1, are provided near the centers of the left and right hinge parts 21 to 22, and are formed in a circular form passing through in and out, respectively. In the left and right rotation holes 23, as shown in FIG. 1, the left and right rotating shafts 35 projecting outwardly from the left and right sides of the base 30 are inserted, respectively. The lid 20 is supported on the base 30 to be capable of rotating around the rotating shafts 35.

(3) Guide Groove 24

The guide groove 24, as shown in FIG. 1, is provided on the hinge part 21 on the left side of the lid 20, and formed in a curved V shape. In the guide groove 24, as shown in FIG. 2, the pin 91 of the first link arm 80 (described later) is inserted, and moves following the guide groove 24.

The guide groove 24 moves the pin 91 in the direction away from the first link arm 80 when the lid 20 is closed by a predetermined angle, for example, 45 degrees (see FIG. 9), from the open position (see FIG. 8), so that a spring 70 is stretched. That is, the guide groove 24 allows the pin 91 to move with an extension line (not shown) of a line joining the rotating shaft 35 of the lid 20 and the support shaft 37 of the first link arm 80 as a boundary.

On the other hand, the pin 91 moves toward a backside away from a free end part of the lid 20 with the extension line as a boundary (not shown) to open the lid 20 (see FIGS. 6 and 7). The guide groove 24 extends in a direction away from the support shaft 37 of the first link arm 80 at the closed position of the lid 20 (see FIG. 2), and, for example, as shown in FIG. 5, has a starting end part 25 near the support shaft 37 and a locking part 26 with a curved roughly L shape extending away from the support shaft 37.

(4) Sector Gear 27

The sector gear 27, as shown in FIG. 1, is provided on the hinge part 21 on the left side of the lid 20, and is formed in a roughly quarter arc. The sector gear 27, as shown in FIG. 2, engages a damping gear of a rotation damper 51 (described later).

Spring Device 40

The spring device 40, as shown in FIG. 1, is mainly constituted by one spring 70.

The spring 70, as shown in FIG. 2, is placed between the base 30 and the lid 20, i.e., between the first link arm 80 and second link arm 90 (described later). When the lid 20 is pushed in to a pushed-in position (see FIG. 6) beyond the closed position (see FIG. 2), the spring 70 is stretched and urges the lid 20 in the opening direction with a spring returning force.

When the lid 20 is closed by a predetermined angle, for example, 45 degrees (see FIG. 9), after opens with the spring returning force, the spring 70 is stretched and urges the lid 20 in the closing direction with the spring returning force. Concretely, the spring device 40, in addition to the spring 70, generally comprises the following parts.

(1) First link arm 80; (2) Second link arm 90; (3) Spring 70; (4) Push arm 100; (5) Return spring 110; and (6) Push rod 120.

The parts of the spring device 40 are not limited to (1)-(6).

First Link Arm 80

The first link arm 80, as shown in FIG. 1, has one end part supported on the base 30 with the support shaft 37 to be capable of rotating.

Concretely, the first link arm 80, as shown in FIG. 1, has the following parts. The parts of the first link arm 80 are not limited to (1)-(2).

(1) Support Hole 81

The support hole 81, as shown in FIG. 1, is formed on the one end part of the first link arm 80, and is supported on the support shaft 37 projecting outwardly from the left side surface of the base 30 to be capable of rotating, as shown in FIG. 2.

(2) Spring Laying Part 82

The spring laying part 82, as shown in FIG. 1, similar to the support hole 81, is formed on the one end part of the first link arm 80 for hooking one end part of the spring 70.

Second Link Arm 90

The second link arm 90, as shown in FIG. 1, has one end part supported on the first link arm 80 to be capable of sliding.

That is, the second link arm 90, as shown in FIG. 1, is formed in a hollow square cylinder with one end part opening and the other end part closed. The second link arm 90 is capable of sliding relative to the first link arm 80 by inserting the other end part of the first link arm 80 from the open one end part of the second link arm 90. The second link arm 90, as shown in FIG. 1, has a pin 91 on the other end part. The pin 91, as shown in FIG. 2, is inserted into the guide groove 24 formed on the hinge part 21 on the left side of the lid 20, and moves along the guide groove 24.

The pin 91 moves toward a front side approaching the free end part of the lid 20 with the extension line (not shown) of the line linking with the support shaft 37 of the first link arm 80 described previously as the boundary to close the lid 20 (see FIG. 2 and FIG. 9). The second link arm 90, as shown in FIG. 2, is urged in the direction approaching the first link arm 80 with the spring returning force of the spring 70 placed between the first link arm 80.

That is, on the other end part having the pin 91 of the second link arm 90, as shown in FIG. 1, a spring laying part 92 facing the spring laying part 82 of the first link arm 80 is formed for fixing one end part of the spring 70. As shown in FIG. 2, the two end parts of the spring 70 are fixed on the spring laying part 82 of the first link arm 80 and the spring laying part 92 of the second link arm 90.

The second link arm 90, as shown in FIG. 2, has the following parts. The parts of the second link arm 90 are not limited to (1).

(1) Boss 93

The boss 93, as shown in FIG. 2, is positioned midway along a length of the second link arm 90, and projects outwardly in a cylindrical form from an inside surface facing the left side surface of the base 30. The boss 93, as shown in FIG. 2, contacts a push-up part 102 of a push arm 100 (described later).

Push Arm 100

The push arm 100, as shown in FIG. 1, is supported on the base 30 for moving the second link arm 90 in the direction away from the first link arm 80 with a push rod 120 (described later) when the lid 20 is pushed in to the pushed-in position (see FIG. 6), thereby stretching the spring 70.

The push arm 100, as shown in FIG. 6, moves the second link arm 90 in the direction away from the first link arm 80, so that the pin 91 moves from the starting end part 25 toward the locking part 26. Concretely, the push arm 100, as shown in FIG. 1, has the following parts. The parts of the push arm 100 are not limited to (1)-(3).

(1) Shaft Stopping Part 101

The shaft stopping part 101, as shown in FIG. 1, is positioned midway along the length of the push arm 100, and is supported on the base 30 to be capable of rotating, that is, on the swivel shaft 36 protruding outwardly from its left side surface.

(2) Push-Up Part 102

The push-up part 102, as shown in FIG. 1 and FIG. 6, is positioned on one end part sandwiching the shaft stopping part 101 for pushing up the second link arm 90 in the direction away from the first link arm 80.

(3) Linkage Shaft 103

The linkage shaft 103, as shown in FIG. 1, is positioned on the other end part sandwiching the shaft stopping part 101, and projects outwardly in a cylindrical form toward a push rod 120 (described later). The linkage shaft 103, as shown in FIGS. 1 and 2, connects the push rod 120 (described later).

Return Spring 110

The return spring 110 is positioned between the push arm 100 and the base 30, as shown in FIG. 6, for returning the push arm 100 rotated around the shaft stopping part 101 when the push rod 120 (described later) is pushed down by the free end part of the lid 20.

Push Rod 120

The push rod 120 has the following parts.

The parts of the push rod 120 are not limited to (1)-(2).

(1) Linkage Hole 121

The linkage hole 121, as shown in FIG. 1, is formed on one end part of the push rod 120, and passes through in and out in a circular form. In the linkage hole 121, as shown in FIG. 2, the linkage shaft 103 of the push arm 100 is inserted, and the push rod 120 is supported on the push arm 100 to be capable of rotating around the linkage shaft 103.

(2) Pressing part 122

The pressing part 122, as shown in FIG. 1, has a bar shape extending from the linkage hole 121. The pressing part 122, as shown in FIGS. 2 and 3, projects upwardly passing through the pass-through hole 33 on the left side of the flange 32 of the lid 20, and is pushed down by the free end part of the lid 20.

Damper device 50

The damper device 50, as shown in FIG. 2, is positioned between the base 30 and the lid 20 for damping the rotational force acting on the lid 20 by the spring returning force of the spring 70.

Concretely, the damper device 50, as shown in FIG. 2, in addition to the sector gear 27 provided on the hinge part 21 on the left side of the lid 20 described previously, comprises the following part. The parts of the damper device 50 are not limited to the sector gear 27 and the following (1). For example, instead of a rotation damper 51, a cylindrical air damper may be used.

(1) Rotation Damper 51

The rotation damper 51 is an oil-filled type, and as shown in FIG. 2, is fixed on the left side surface of the base 30 with a damping gear engaging the sector gear 27.

Cushion Member 60

The cushion member 60 made of, for example, rubber, is installed in the pass-through hole 34 on the right side of the flange 32 of the base 30, and projects outwardly and upwardly from the upper surface of the flange 32 of the base 30. The cushion member 60 elastically contacts an inside surface of the free end part of the lid 20.

Method of Using the Opening and Closing Apparatus 10

The opening and closing apparatus 10 having the above constitution is used in the following manner.

First, when opening the closed lid 20, as shown in FIG. 6, the upper surface of the free end part of the lid 20 is pushed downwardly toward the base 30. When the lid 20 is pushed downwardly, as shown in FIG. 6, the lower surface thereof is pushed and the pressing part 122 of the push rod 120 descends. When the push rod 120 descends, as shown in FIG. 6, the linkage shaft 103 of the push rod 120 inserted inside the linkage hole 121 descends.

Accompanying the descent of the linkage shaft 103 of the push rod 120, as shown in FIG. 6, the push-up part 102 positioned on the opposite side sandwiching the swivel shaft 36 projecting outwardly from the left side surface of the base 30 ascends. Therefore, by the push-up part 102 of the push rod 120, as shown in FIG. 6, the boss 93 of the second link arm 90 is pushed up. Accompanying the ascent of the boss 93 of the second link arm 90, as shown in FIG. 6, the second link arm 90 moves in the direction away from the first link arm 80. Accordingly, the spring 70 is stretched, and the urging force is accumulated.

At this time, the pin 91 of the second link arm 90, as shown in FIG. 6, moves inside the guide groove 24. That is, the pin 91 positioned at the starting end part 25 near the support shaft 37 of the guide groove 24 as shown in FIG. 2 moves toward the locking part 26, and then is inserted and locked inside the locking part 26 as shown in FIG. 6.

After that, when the force pushing up the lid 20 is released, the lid 20, as shown in FIGS. 7 and 8, is opened by the spring returning force as the spring 70 contracts. At this time, through the engagement with the sector gear 27 of the lid 20, as shown in FIGS. 7 and 8, the damping force of the rotation damper 51 acts by the rotation of the damping gear of the rotation damper 51, so that the lid 20 opens slowly and quietly.

In the course of opening of the lid 20, the pin 91 of the second link arm 90, as shown in FIG. 7, contacts the stopper 38 projecting outwardly from the left side surface of the base 30. Therefore, the pin 91 inserted into the locking part 26 of the guide groove 24, as shown in FIG. 7, moves toward the starting part 25. At the open position of the lid 20, as shown in FIG. 8, the pin 91 of the second link arm 90 is positioned at the starting end part 25 of the guide groove 24.

On the other hand, when closing the lid 20 in the open state, as shown in FIG. 9, the lid 20 is closed by 45 degrees with a hand. At this time, by the rotation of the lid 20, as shown in FIG. 9, the position of the guide groove 24 is displaced. Therefore, the pin 91 inserted into the guide groove 24 moves in the direction away from the support shaft 37 of the base 30, and the second link arm 90, as shown in FIG. 9, moves in the direction away from the first link arm 80. Accordingly, the spring 70 is stretched and the urging force is accumulated.

At this time, the pin 91 positioned at the starting end part 25 of the guide groove 24 moves slightly toward the locking part 26 (not shown). After that, when the hand is released from the lid 20, the lid 20, as shown in FIG. 9, is closed by the spring returning force as the spring 70 attempts to contract. At this time, by the engagement with the sector gear 27 of the lid 20, as shown in FIG. 9, the damping force of the rotation damper 51 acts by the rotation of the damping gear of the rotation damper 51, so that the lid 20 is closed slowly and quietly.

Even when the lid 20 is in the closed state, the spring 70 is somewhat stretched, and the lid 20 is urged in the closing direction with the spring returning force. Therefore, the lid 20 is not unexpectedly opened by vibration of the car, and the like. Even if a force acts by vibration of the car, and the like in the opening direction of the lid 20, because the position of the guide groove 24 is displaced, the second link arm 90 moves in the direction away from the first link arm 80 by the pin 91. Accordingly, the amount that the spring 70 is stretched is increased. Therefore, even if the lid 20 is slightly opened, the lid 20 is closed as before by the spring returning force as the spring 70 attempts to contract.

For the reasons mentioned above, in the preferred embodiment of the present invention, a mechanism for locking the lid 20 in the closed state is not provided, and may be provided. When such a mechanism is provided for locking the lid 20 in the closed state, a rattling of the lid 20 can be prevented when driving on a rough road, and the like.

The disclosure of Japanese Patent Application No. 2003-422653, filed on Dec. 19, 2003, is incorporated in the application.

While the invention has been explained with reference to the specific embodiments of the invention, the explanation is illustrative and the invention is limited only by the appended claims.

What is claimed is:

1. A lid opening and closing apparatus, comprising:

a base having an open portion, a lid having a rotational shaft and supported on the base to be rotatable around the rotating shaft for opening and closing the open portion, and connecting means for connecting the base and the lid having one spring disposed between the base and the lid, said one spring being stretched for urging the lid in a closed portion to an opening direction when the lid is pushed to a pushed-in position beyond the closed position, said one spring being stretched for urging the lid in an open position to a closing direction when the lid is closed to a predetermined angle, wherein said connecting means further comprises a first link arm having one end part with a support shaft rotatably supported on the base; a second link arm having one end part slidably attached to the first link arm and the other end part with a pin, said second link arm being urged in a direction approaching the first link arm by the one spring arranged between the first and second link arms; a push arm supported on the base for extending the second link arm further from the first link arm when the lid is pushed to the pushed-in position to thereby stretch the one spring; and a guide groove provided in the lid for guiding the pin, said guide groove moving the pin in a direction away from the first link arm when the lid is closed by the predetermined angle from the open position to thereby stretch the one spring.

2. A lid opening and closing apparatus according to claim 1, wherein said guide groove is arranged such that the one spring is stretched for urging the lid in the closing direction when the lid is closed to about 45 degrees.

3. A lid opening and closing apparatus according to claim 1, wherein said guide groove is arranged to allow the pin to move in opposite directions with respect to a line passing through the rotating shaft of the lid and the support shaft of the link arm as a boundary, said pin moving toward a back side away from a free end part of the lid with respect to the line to thereby open the lid and moving toward a front side approaching the free end part of the lid with respect to the line to thereby close the lid.

4. A lid opening and closing apparatus according to claim 1, wherein said guide groove includes a starting end part and a locking part located away from the starting end part and having a curved shape, said first link arm being located at the starting end part when the lid is at the closed position, said push arm, upon actuation, moving the second link arm in the direction away from the first link arm so that the pin moves from the starting end part toward the locking part.

5. A lid opening and closing apparatus according to claim 4, wherein said base includes a stopper for engaging the pin while the lid is opening so that the pin moves from the locking part toward the starting end part.

6. A lid opening and closing apparatus according to claim 1, wherein said push arm includes a shaft part positioned midway along a length thereof and rotatably supported on the base, a pressing part positioned on one end part of said push arm relative to the shaft part and projecting toward the lid, said pressing part being pushed down by the free end part of the lid, and a push-up part positioned on an opposite end part of the push arm relative to the shaft part for pushing up the second link arm in the direction away from the first link arm.

7. A lid opening and closing apparatus according to claim 6, further comprising a return spring provided between the push arm and the base for returning the push arm when the pressing part is pushed down by the free end part of the lid.

8. A lid opening and closing apparatus according to claim 1, further comprising a damper device provided between the base and the lid for damping a rotational force acting on the lid.

9. A lid opening and closing apparatus according to claim 8, wherein said lid includes a hinge part having said guide groove and said rotational shaft, and engaging the damper device.

* * * * *